US005787648A

United States Patent [19]

O'Malley

[11] Patent Number: 5,787,648

[45] Date of Patent: Aug. 4, 1998

[54] WORKSTATION WITH WORK SURFACE

[75] Inventor: Patric O'Malley, New York, N.Y.

[73] Assignee: M. Arthur Gensler Jr. & Associates, Inc., New York, N.Y.

[21] Appl. No.: 820,591

[22] Filed: Mar. 19, 1997

[51] Int. Cl.[6] ..... A47B 5/02; A47B 51/00

[52] U.S. Cl. ..... 52/36.1; 52/79.1; 52/79.4; 52/36.5; 108/50; 312/223.3

[58] Field of Search ..... 52/36.1, 79.1, 52/79.4, 65, 36.5; 312/312, 242, 107, 109, 223.3, 208.1, 208.2; 108/50, 147

[56] References Cited

U.S. PATENT DOCUMENTS

| | | | |
|---|---|---|---|
| 4,161,850 | 7/1979 | Peterson et al. | 52/65 |
| 4,571,900 | 2/1986 | Kelman | 52/65 |
| 4,685,255 | 8/1987 | Kemey | 52/36.1 |
| 4,761,921 | 8/1988 | Nelson | 52/36.1 X |
| 5,065,832 | 11/1991 | Mark | 108/50 X |
| 5,265,952 | 11/1993 | Greshem et al. | 108/50 X |
| 5,277,130 | 1/1994 | Caporrella | 108/50 |
| 5,309,686 | 5/1994 | Underwood et al. | 312/223.3 X |
| 5,352,033 | 10/1994 | Greshem et al. | 108/50 X |
| 5,394,658 | 3/1995 | Schreiner et al. | 52/36.1 |
| 5,403,082 | 4/1995 | Kramer | 108/50 X |
| 5,410,972 | 5/1995 | Schairbaum | 108/50 X |
| 5,473,994 | 12/1995 | Foley et al. | 108/50 |
| 5,522,323 | 6/1996 | Richard | 108/50 X |
| 5,655,823 | 8/1997 | Schaibbaum | 108/50 X |

OTHER PUBLICATIONS

Steelcase, Inc. "Brochure for Personal Harbor", Oct., 1994.

*Primary Examiner*—Christopher Kent
*Assistant Examiner*—Yvonne Horton-Richardson
*Attorney, Agent, or Firm*—Colucci & Umans

[57] ABSTRACT

A workstation has a work surface with a front edge which a user faces in a front facing position at the workstation. A first inner side edge extends from one end of the front edge at a first angle to the front edge and on one side of the front facing position, and a second inner side edge extends from an opposite end of the front edge, at a second angle and on an opposite side of the front facing position. First and second outer bounding edges, have first ends connected to each other at an angle of about 70–110 degrees, each of the first and second outer edges having opposite second ends. A first outer side edge is connected between the second end of the first outer bounding edge and the first inner side edge and a second outer side edge is connected between the second end of the second outer bounding edge and the second inner side edge. The first and second angles each are between about 100 and 115 degrees so that the front edge and the first and second inner side edges embrace the facing position without constricting movement of a user in the facing position. The first inner side and outer side edges are connected to each other at a curved corner and, with at least a portion of the first outer bounding edge, define a conference area at which the user in the facing position and another individual spaced from the user can work at the same time.

12 Claims, 3 Drawing Sheets

WORKSTATION WITH WORK SURFACE

FIELD AND BACKGROUND OF THE INVENTION

The present invention relates in general to workstations, and in particular, to a new and useful workstation and enclosure with a uniquely shaped work surface that optimizes the versatility and usefulness of the workstation.

A workstation is an area normally dedicated to desk work and the like, which is meant to provide easy access to all the tools that the user will need to perform his or her task.

With an increased premium placed on space, efforts have been made to maximize the efficiency of workstations and minimize the amount of space needed for them. Another trend in workstation design is to relegate each worker to his or her own "cubicle", that is, a partly enclosed work area which contains a work surface and the tools the worker will need to perform his or her task. Such tools increasingly include electronic and electrical equipment such as computers and word processors with their CPU, monitor, keyboard and mouse, a telephone, a transcriber or dictating machine and the usual assortment of papers, pencils, pens, staplers and other devices normally found on, in and around a desktop.

Although the designing and outfitting of workstations is perceived to be a high-tech, modern exercise, in fact, the assembly of appropriate work surfaces, storage locations and equipment for facilitating desk work is an ancient art as evidenced by a painting of Saint Jerome in his study during the middle ages.

A more modern example of a workstation having a work surface, storage locations and equipment in a cubicle, has been disclosed and sold by Steelcase, Inc. of Grand Rapids, Mich. and known by the trademark "PERSONAL HARBOR". This workstation utilizes an L-shaped, two level work surface with shelves for equipment, all mounted within an enclosure.

Desks designed to be placed in the corner of a room are also known. These desks generally have outer border edges that meet at 90 degrees and which are designed to be placed near the corner of a room. A front edge of the work surface extends at 45 degrees to the edges. This type of desk design is often used in juvenile bedroom furniture and is usually bounded on opposite sides of the front edge of the work surface by chests of drawers which have edges that extend parallel to the adjacent walls of the room and therefore at an angle of 135 degrees to the front edge of the work surface. Even if the top surfaces of the adjacent chests of drawers were used to augment the top surface of the desk, these surfaces would require a long reach by the user of the desk and are generally not readily accessible nor appropriate for placement of items such as telephones, the keyboard or mouse.

U.S. Pat. No. 5,416,666 discloses an ergonomic operator workstation having a monitor and a wing unit. This patent discloses the use of a curved surface faced by the user and space under the curved surface for the users legs.

SUMMARY OF THE INVENTION

An object of the present invention is to provide a uniquely shaped work surface for a workstation and a workstation and enclosure combination, which has been carefully designed to maximize the usefulness of the work surface and the accessibility of as many portions of the work surface as possible.

According to the present invention, the work surface also provides a conference area despite the very modest space requirements.

Accordingly, a further object of the present invention is to provide a workstation comprising: means defining a work surface; the work surface having a front edge which a user faces in a front facing position at the workstation; a first inner side edge extending from one end of the front edge, at a first angle to the front edge and on one side of the front facing position; a second inner side edge extending from an opposite end of the front edge, at a second angle and on an opposite side of the front facing position; first and second outer bounding edges, each of the first and second bounding edges having first ends connected to each other at an angle of about 70–110 degrees, each of the first and second outer edges having opposite second ends; a first outer side edge connected between the second end of the first outer bounding edge and the first inner side edge; a second outer side edge connected between the second end of the second outer bounding edge and the second inner side edge; the first and second angles each being between about 100 and 115 degrees so that the front edge and the first and second inner side edges embrace the front facing position without constricting movement of a user in the front facing position; the first inner side and outer side edges being connected to each other at a curved corner and, with at least a portion of the first outer bounding edge defining a conference area at which the user in the facing position and another individual spaced from the user can work at the same time.

Another object of the present invention is to provide such a workstation which includes enclosing walls extending parallel to and adjacent first and second bounding edges for at least partly enclosing the work surface, the enclosing wall adjacent the first bounding edge containing a doorway opening which is near the conference area of the work surface.

A still further object of the present invention is to provide a workstation which has other unique characteristics and which includes various storage, door and other features that further enhance the work environment of the user.

A further object of the present invention is to provide a work surface which is uniquely shaped in order to provide optimal use of minimal space without overly confining or constricting movement of the user.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
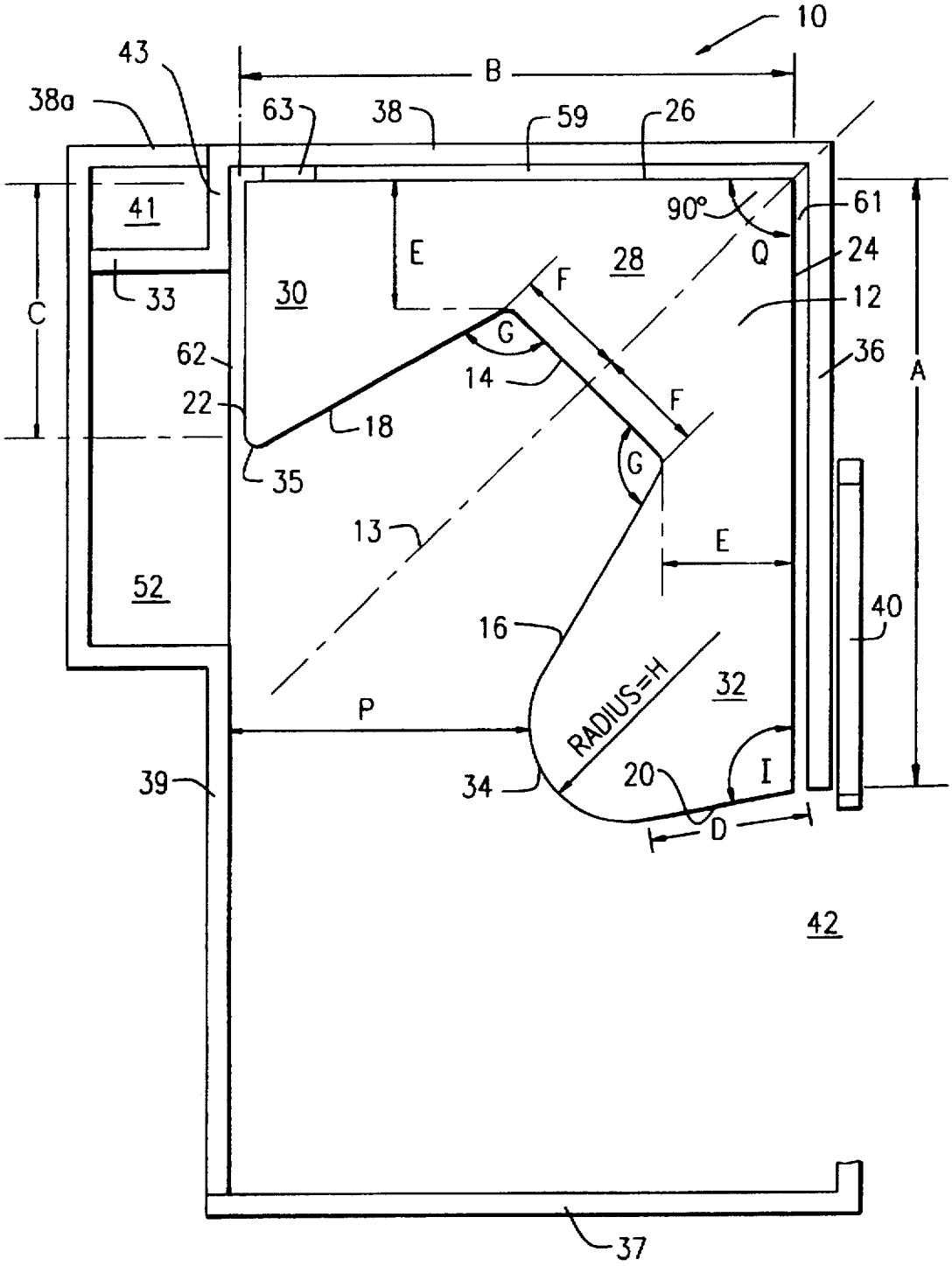
FIG. 1 is a top plan view of a workstation of the present invention including the work surface of the invention and other features which can be used in combination with the work surface.

Referring to the drawings in particular, the invention embodied in FIG. 1 comprises a workstation generally designated 10 which contains a counter 12 defining a work surface that has been designed to optimize the space available in the workstation.

Although the work surface is shown mounted within a cubicle forming part of the workstation of the present invention, it is understood that the work surface may also be free standing or mounted to the panels of the cubicle.

Some important features of the present invention will become apparent from the detailed description of the invention include bi-lateral symmetry which remains effective for both left and right-handed users. The wing configuration of the work surface surrounds the user and offers working surfaces on the three sides of the user without constricting movement of the user. The various edges of the work surface come together at corners which are preferably rounded with the roundness of one of the corners near a conferencing area of the work surface being selected to improve use of this area, both by the user of the workstation and a guest user.

The present invention produces maximum use of the space within the confines of the workstation with sufficient space at the center of the work surface to accommodate a retractable keyboard tray.

The workstation and in particular the work surface of the present invention complies with the Americans With Disabilities Act, another beneficial feature of the invention.

Returning to FIG. 1, the work surface comprises a front edge 14 which is preferably straight but may be slightly curved. The front edge is meant to be faced by a user in a front facing position in the workstation. This front facing position would be taken by a user sitting in chair 11 in the position shown in FIG. 3. Returning to FIG. 1, first and second inner side edges 16 and 18 extend outwardly from opposite ends of the front edge 14 at angles G which are preferably equal to each other but not necessarily equal to each other. Each angle G is optimally about 106 degrees although it can be within the range of about 100 to about 115 degrees. It is important that angles G not be 90 degrees or smaller since this would overly constrict movement of the user and impede entry and exit of the user into and out of the working position at the work surface.

Work surface or counter 12 also includes first and second outer bounding edges 24 and 26 which have first ends that are connected to each other at angle Q which is advantageously about 90 degrees but may be from 70–110 degrees. The 90 degree quantity for angle Q is preferred to maximize the use of space in a rectangular cubicle and also to maximize the symmetry of the work surface around a central axis 13 extending through the approximate center of edge 14 and center of work surface 12.

A second outer side edge 22 is connected between an opposite second end of the second outer bounding edge 26, and the end of second inner side edge 18 opposite from angle G. Advantageously, a rounded corner 35 is used which decreases the chance of injury to someone who strikes the corner. Curved corners are also used at angles G,G, between edge 14 and edges 18 and 16. This has been found to be more comfortable and user-friendly than sharp inside corners.

A first outer side edge 20 is also connected between the second end of the first outer bounding edge 24 and the outer end of first inner side edge 16, opposite from angle G. The corner formed by edges 16 and 20 is also rounded at 34 but is rounded at a greater radius to produce a conferencing or conference area 32 at which the user can sit and a guest user can also sit. This is despite the relatively small size of the cubicle. Advantageously, the radius of curvature H of corner 34 is between about 9 and about 16 inches and has been found to be optimal at about 12 inches. The radius is scaled to the optimal lengths of the edges around the work surface. Dimensions F,F on opposite sides of the line of symmetry to the angles G has been found to be optimal at 11 inches with the total length of edge 14 being advantageously about 20 to about 24 inches. A straight portion of first outer side edge 20, before it curves into corner 34, shown at dimension D, has been found to be optimal at 19 inches or within the preferred range of about 15 to about 23 inches. Edge 20 is advantageously at an angle I of 98 degrees to first outer bounding edge 24, or advantageously within the preferred range of about 92 to 105 degrees. It has been found advantageous to make angle I greater than 90 degrees to increase the size of the conference area 32 without overly interfering with a doorway opening 42 in an entry wall 36 enclosing first outer bounding edge 24. It is noted that wall 36 is advantageously a half-wall or a wall with a transparent panel above and an opaque panel below. Wall 36 is advantageously higher than the horizontal level of work surface 12 for privacy.

A second enclosing wall 38 is connected to the first enclosing wall 36 at a 90 degree angle. An opposite enclosing wall 37 extends parallel to wall 38 and is spaced by about 10 feet from wall 38 to establish the large dimension of the cubicle for workstation 10. An interior partition 39 which is shared with an adjacent workstation and which contains shelves, storage elements and other features useful to the user, extends parallel to entry wall 36 and is spaced by about 6 feet from wall 36. It is also important to maintain a dimension P for a passageway, for allowing the user to enter into his or her working space of at least 36 inches from partition 39 to the point on corner 34 which is closest to partition 39.

Doorway 42 is also advantageously about 36 inches long and can be closed with a sliding door 40 having, for example, a glass upper portion in the case where walls 36, 38 and 37 also have glass upper portions. Alternatively, door 40 can be a half-high door or a fully opaque full length door.

Figure 3:
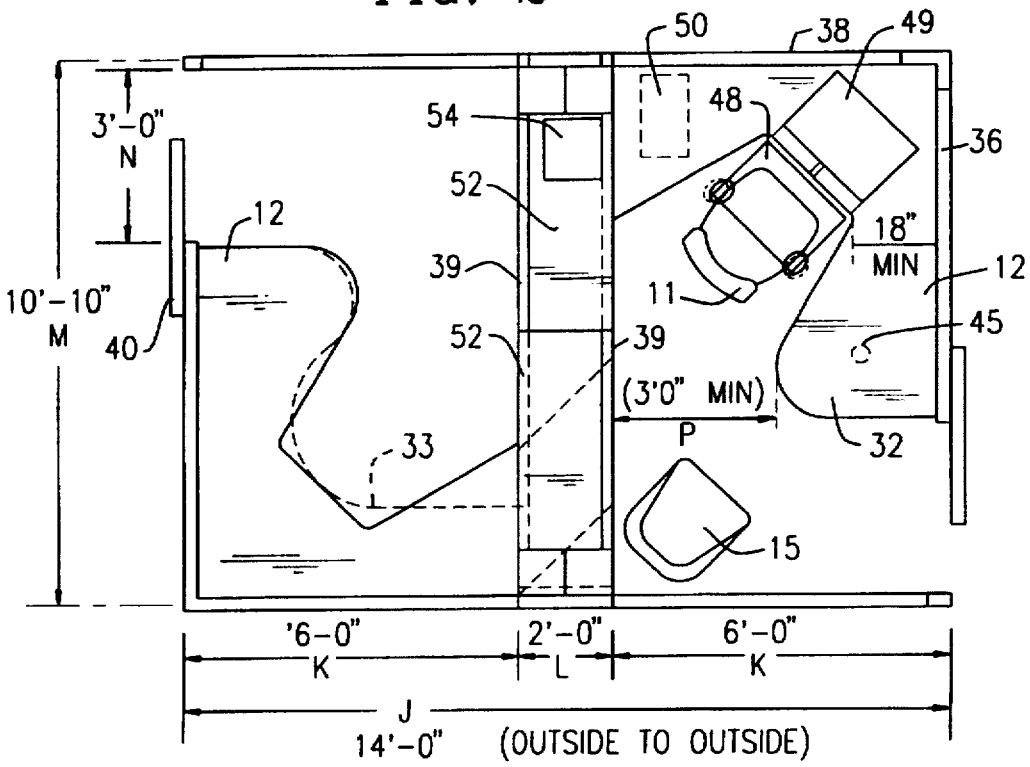
FIG. 3 is a view of two mated workstations including their work surfaces and enclosures illustrating how multiple workstation of the present invention can be used in combination with each other.

The length C of edge 22 is also selected to advantageously be 2 feet-8 inches or from about 2 feet-4 inches to about 3 feet-2 inches. This gives the user a generous side working area 30 which is maximally accessible. The dimensions E which may be equal to or different from each other, is equal to the shortest distance between the corners at angles G and the respective bounding edges 24 and 26. This dimension is advantageously 18 inches and preferably in the range of about 14–22 inches. These dimensions again are selected to maximize the useful area of the work surface. This also provides a generous front work area 28. Advantageously, and best shown in FIG. 3, a monitor can be provided in a monitor area 49 which is adjacent corner Q. A pull-out tray which is pulled out from the bottom of work surface 12 at 48, is for supporting a keyboard. A space under work surface 12 shown by dotted lines 50 is provided for storing a CPU in a CPU shelf or drawer of conventional design. A shelf 52 which is accessible from inside workstation 10 in FIG. 1, is also provided for the user of the workstation and can be used for various items including, for example, a user printer space 54. FIG. 3 also illustrates how two workstations can be mated with each other, each with their own shelf 52 and work surfaces 12 which are mirror symmetrical with respect to each other around partitions 39,39. Partitions 39,39 are spaced apart by dimension L, preferably about 2 feet. This provides the dimension for the shelves 52. FIG. 3 also illustrates the preferred location for a guest user chair 15 for a guest who can use conference area 32 with the user in chair 11.

The cubicle on the left in FIG. 3 illustrates a dotted line at 33, the contour of a less optimum work surface which has been found by the inventor to be less useful than the work surface configuration shown in solid line. As noted above, dimensions N and K (about 10 feet by about 6 feet) define the general size of each cubicle with the passageway opening of dimension N being about 3 feet and the overall length of the two workstations being only about 14 feet (dimension J). Despite this very conservative use of space, two individuals are given optimal space to work and study.

Figure 2:
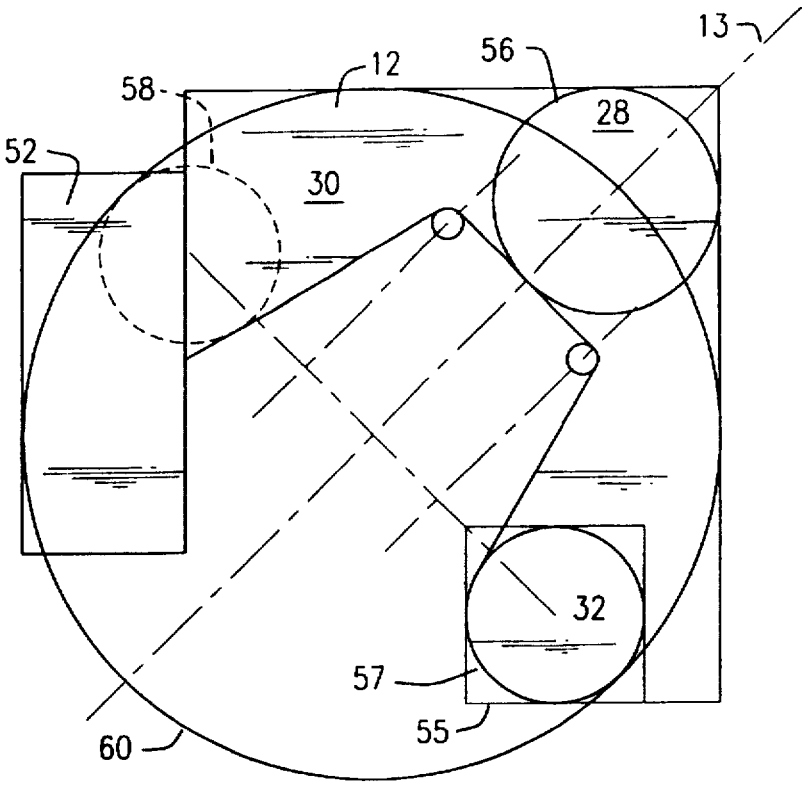
FIG. 2 is a top plan view of the work surface and an adjacent storage surface showing various functional areas and relationships of these areas for optimal use of the workstation.

FIG. 2 illustrates the inventors thinking in selecting the shape of work surface 12. The work surface is divided into circular areas of storage or access. For example, circle 56 roughly defines the front work area 28 and can be the place for a monitor, a mouse or other small element used in conjunction with a computer, or even for papers, pens and pencils for use of the work surface as a writing surface. Conference area 32 is bounded by an imaginary circle 57 bounded in turn by a square 55, the more conventional shape for a conference area. The corners of square 55 are removed, however, both for access of both parties and because the area lost is minimal compared to the improved accessibility provided.

Imaginary circle 58 is another access area which shares side work area 30 and a portion of the shelf area 52 which is advantageously at the same level as work surface 12.

Finally, a large imaginary circle 60 identifies the movement area of a user at the workstation who may move around and reach items in this circle, such as telephones, dictating and transcribing equipment and other tools which are spread about surfaces 12 and 52.

To help maximize the useful space in shelf 52, which is about 24 inches deep and about 5 feet 6 inches long, the shelf 52 does not extend all the way to the plane of wall 38 but rather stops at an intermediate wall 33. A space 41 (see FIG. 1) beyond an intermediate wall 33, can be accessed from a wall 43 adjacent the work surface 12 and provided with vertically spaced shelves for less used equipment which will be somewhat more difficult to reach because of its placement. Alternatively, a continuation 38*a* of wall 38 may be open to provide access into space 41 from outside the workstation cubicle. Alternatively, the space can be used for conduits, lighting, speakers or other equipment that is either shared by the adjacent workstation or common elements in the larger work area.

The overall dimension of edge 24 which is preferably a straight edge, is shown at A and is advantageously about 6 feet or about 5 feet to about 7 feet. Edge 24, also straight, has a dimension B of about 5 feet-6 inches or advantageously between about 5 feet and 6 feet-6 inches. The enclosing walls are re-positioned or enlarged for accommodating the different sized work surfaces.

Another feature of the invention is that a space 59, 61 and 62 is provided between the work surface 12 and the adjacent walls or shelf. This permits electrical and data lines from the various electrical and electronic devices above and below the work surface panel 12 to pass without difficulty. Alternatively, shelves which are below the level of work surface 12 are provided in spaces 59, 61 and 62, with one or more access openings that pierce the shelf, for example, at 63.

Figure 4:
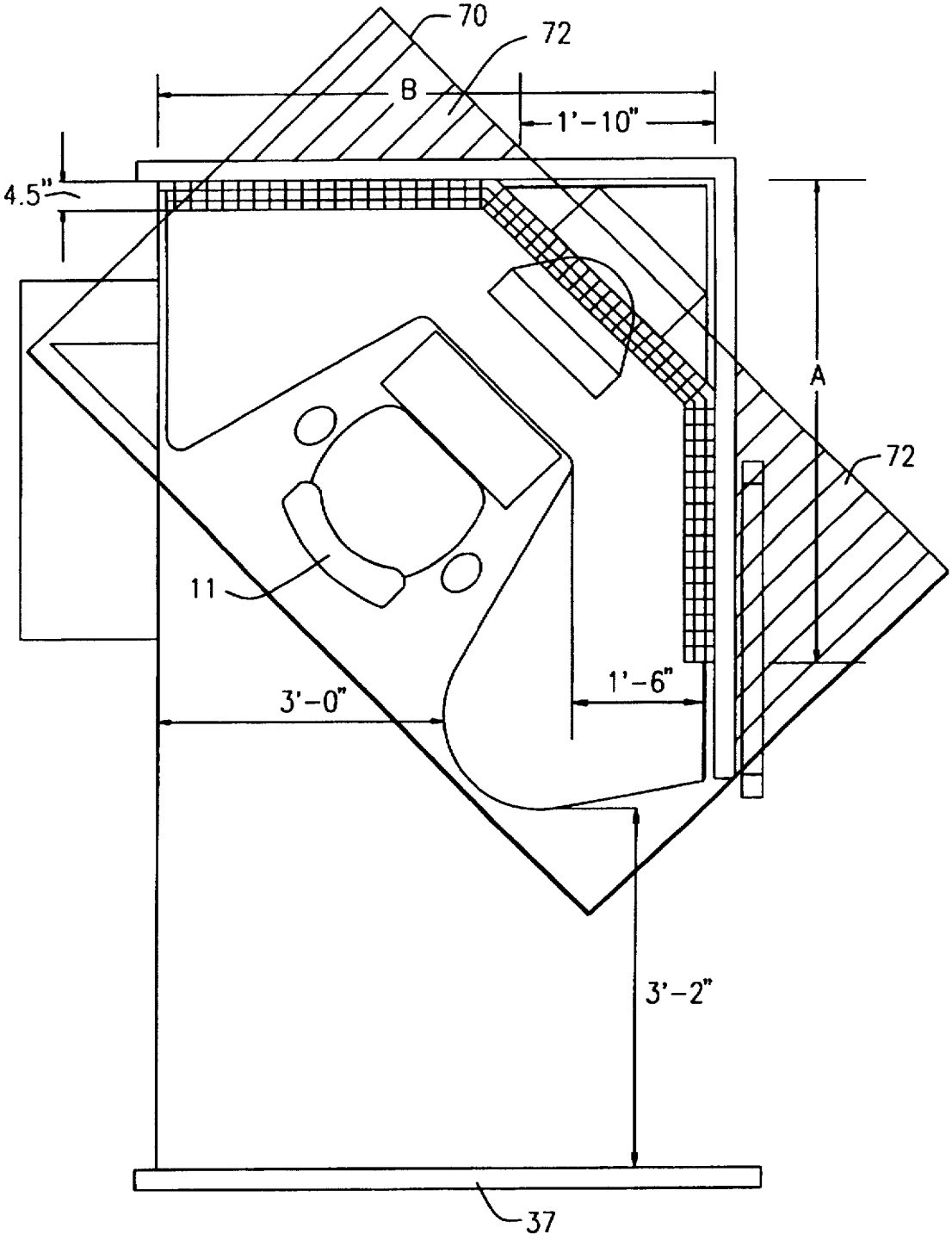
FIG. 4 is a view similar to FIG. 1 showing a rectangular work area superimposed on the work surface of the present invention to illustrate the effectiveness of the work surface.

FIG. 4 illustrates the invention with a rectangular work space 70 that has front and back walls that are aligned with the forward facing position of a user in chair 11. FIG. 4 illustrates the lack of efficiency of this shape since it includes areas such as cross-hatched areas 72, which, in effect, are dead zones which cannot readily be reached by the user.

In FIG. 3, pedestal 45 is shown for holding up the end of the work surface 12 which carries the conference area 32. The remaining bounding edges and second outer side edge of the work surface can be supported above the floor, for example, by being hung on the walls 36 and 38. Advantageously, the space under the conference area 32 and under the front work surface 28 is free of storage and other obstructions to leave room for the legs, knees and feet of the user and the guest user.

While a specific embodiment of the invention has been shown and described in detail to illustrate the application of the principles of the invention, it will be understood that the invention may be embodied otherwise without departing from such principles.

What is claimed is:

1. A workstation comprising:

means defining a work surface;

the work surface having a front edge which a user faces in a front facing position at the workstation;

a first inner side edge extending from one end of the front edge, at a first angle to the front edge and on one side of the front facing position;

a second inner side edge extending from an opposite end of the front edge, at a second angle and on an opposite side of the front facing position;

first and second outer bounding edges, each of the first and second bounding edges having first ends connected to each other at a third angle of about 90 degrees, each of the first and second outer edges having opposite second ends;

a first outer side edge connected between the second end of the first outer bounding edge and the first inner side edge;

a second outer side edge connected between the second end of the second outer bounding edge and the second inner side edge;

the first and second angles each being between 100 and 115 degrees so that the front edge and the first and second inner side edges embrace the front facing position without constricting movement of a user in the front facing position;

the first inner side and first outer side edges being connected to each other at a curved and exposed corner and, with at least a portion of the first outer bounding edge, defining a conference area at which the user in the facing position and another individual spaced from the user can work at the same time;

the second inner side and second outer side edges being connected to each other at a further, interior corner which is smaller than said curved exposed corner;

first and second enclosing walls extending along and adjacent to the first and second outer bounding edges respectively for at least partly enclosing the work surface;

a doorway passage in the first enclosing wall extending along the first outer bounding edge, and opening adjacent the curved exposed corner for easy access by the other individual near the curved exposed corner and in the conference area; and a partition extending parallel to and spaced from the first enclosing wall extending along the first outer bounding edge, a least distance between the partition wall and the curved exposed corner between the first inner and outer side edges being at least about 3 feet.

2. A workstation according to claim 1 wherein the first inner and outer side edges meet at a curved corner, curved at a radius of about 9–16 inches.

3. A workstation according to claim 2 wherein the radius is about 12 inches.

4. A workstation according to claim 1 wherein the edges are all straight, the first and second inner side edges meeting the front edge at curved corners, the second inner side edge meeting the second outer side edge at a curved corner and the front edge and first and second side edges being substantially symmetrically about an axis extending through a center of the front edge and through the third angle.

5. A workstation according to claim 1 wherein the first and second angles are approximately equal to each other and approximately equal to about 106 degrees.

6. A workstation according to claim 1 including a shelf at a horizontal level which is about the same as a horizontal level of the work surface, extending adjacent the second outer side edge and being in the partition and adjacent the further interior corner.

7. A workstation according to claim 1 wherein a shortest distance between the first angle and the second outer bounding edge and the shortest distance between the second angle in the first outer bounding edge are each about 14–22 inches.

8. A workstation according to claim 7 wherein the distances are about 18 inches.

9. A workstation comprising:

means defining a work surface;

the work surface having a front edge which a user faces in a front facing position at the workstation;

a first inner side edge extending from one end of the front edge, at a first angle to the front edge and on one side of the front-facing position;

a second inner side extending from an opposite end of the front edge, at a second angle and on an opposite side of the front facing position;

first and second outer bounding edges, each of the first and second bounding edges having first ends connected to each other at a third angle of about 90 degrees, each of the first and second outer edges having opposite second ends;

a first outer side edge connected between the second end of the first outer bounding edge and the first inner side edge;

a second outer side edge connected between the second end of the second outer bounding edge and the second inner side edge;

the first and second angles each being between about 100 and 115 degrees so that the front edge and the first and second inner side edges embrace the front facing position without constricting movement of a user in the front facing position;

the first inner side and first outer side edges being connected to each other at a curved and exposed corner and, with at least a portion of the first outer bounding edge, defining a conference area at which the user in the facing position and another individual spaced from the user can work at the same time;

the second inner side and second outer side edges being connected to each other at a further, interior corner which is smaller than said curved exposed corner; and an enclosure for enclosing the work surface, having walls adjacent the first and second outer bounding edges and a guest user space adjacent the corner between the first inner and outer edges, the enclosure having a doorway adjacent the guest user space and dimensions of about 5–7 feet between the first outer bounding edge and the second outer side edge and about 9 to 11 feet between an enclosed guest user space and the second outer bounding edge.

10. A workstation according to claim 9 including means defining a doorway in the enclosure adjacent the conference area on the work surface and a passage between the conference area and a wall enclosure opposite from the doorway.

11. A workstation according to claim 10 wherein the doorway and passage are each at least about 3 feet wide.

12. A workstation according to claim 9 including a space between the walls of the enclosure and the first and second bounding edges and the second outer side edge of the work surface.

* * * * *